United States Patent [19]

Riedl

[11] Patent Number: 4,543,298

[45] Date of Patent: Sep. 24, 1985

[54] METAL CORD

[75] Inventor: Josef Riedl, Styria, Austria

[73] Assignee: Stahlcord Betriebsgesellschaft m.b.H., Austria

[21] Appl. No.: 642,861

[22] Filed: Aug. 21, 1984

[30] Foreign Application Priority Data

Aug. 24, 1983 [AT] Austria ..... 3019/83

[51] Int. Cl.[4] ..... B60C 9/00; D07B 1/06

[52] U.S. Cl. ..... 428/592; 428/625; 57/902

[58] Field of Search ..... 428/592, 624, 625, 626; 152/359; 57/902, 215, 217, 219, 221, 223

[56] References Cited

U.S. PATENT DOCUMENTS

| | | | |
|---|---|---|---|
| 1,943,087 | 1/1934 | Potter et al. | 428/592 |
| 3,495,646 | 2/1970 | Marzocchi | 152/359 |
| 3,922,841 | 12/1975 | Katsumata et al. | 57/215 |
| 3,949,141 | 4/1976 | Marzocchi et al. | 57/902 |
| 4,158,946 | 6/1979 | Borgois | 152/359 |
| 4,197,894 | 4/1980 | Boileau | 152/359 |
| 4,349,063 | 9/1982 | Kikuchi et al. | 152/359 |
| 4,458,475 | 7/1984 | Schmit et al. | 57/902 |
| 4,488,587 | 12/1984 | Umezawa et al. | 57/902 |

FOREIGN PATENT DOCUMENTS

| | | | |
|---|---|---|---|
| 2224342 | 11/1972 | Fed. Rep. of Germany | 152/359 |
| 2080845A | 2/1982 | United Kingdom | 57/215 |

*Primary Examiner*—L. Dewayne Rutledge
*Assistant Examiner*—John J. Zimmerman
*Attorney, Agent, or Firm*—Seidel, Gonda, Goldhammer

[57] ABSTRACT

The present invention relates to the improvement of metal cords for the reinforcement of elastomeric bodies, in particular of vehicle tires which are provided with retaining helixes on their outsides. The problem was to avoid the disadvantageous properties of the retaining helixes in reinforced elastomeric bodies, namely, the impairment of the inherent elasticity of the metal cord and the fretting of the retaining helixes on the outer layer of the metal cord. The problem particularly resided in the improvement of socalled compact cords, meaning cords consisting of layers of identical twisting sense. For the solution of this problem, it is proposed to provide a core strand of shorter twisting pitch (twisting pitch ratio of preferably 1:2 or less) than the twisting pitch of the adjacent outer layer; this in particular in the case of metals cords having more than two layers. For this purpose, the retaining helix can be of a cross section deviating from a circle, in particular of flattened cross section, and consists of metal or of a material whose softening temperature is at least partially lower than or within the cross-linking temperature range of the elastomer to be reinforced; the retaining helix can have the form of a metal/plastics composite or compound body or of a plastics body. The softening portion of the material of the retaining helix is so selected that it is compatible with the elastomer, meaning that no reactions impairing the adhesion between metal cord and elastomer occur between the softening portion of the material of the retaining helix and the elastomer.

5 Claims, 2 Drawing Figures

METAL CORD

Figure 2:
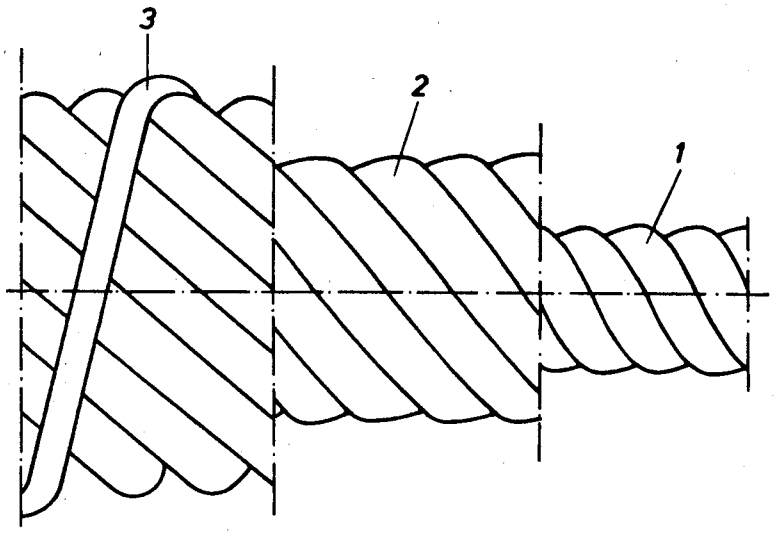

The invention relates to a metal cord for the reinforcement of elastomeric bodies such as vehicle tires, conveyor belts or hoses, consisting of a plurality of strands of preferably identical twisting sense, which cord is provided on its outside with at least one retaining helix.

Retaining helixes are normally single wires of small diameter (such as 0.15 mm) which are wound onto metal cords in an identical or opposite twisting sense in relation to the surface layer, with a twisting pitch of about 2 to 3 mm. The retaining helixes serve for increasing the flexibility of the metal cord at the time of its insertion into (assembly with) the elastomeric article to be reinforced, for instance a green vehicle tire. In other words, care is to be taken at insertion of the metal cord to prevent its "coming undone", i.e. its losing its cross-sectional coherence, on the one hand, and its stretching out again, i.e. its returning to its original straight form due to its inherent elasticity, on the other hand.

After cross-linking (vulcanizing) of the polymeric material, the metal cord is completely embedded in an elastic polymeric matrix and there is no longer any danger of its coming undone, so that its inherent elasticity should now come into full play, which is impeded by its retaining helixes.

The assembling advantages of retaining helixes are so great that up to now, the above-mentioned disadvantages in finished metal cord-reinforced products have been put up with.

Particularly in reinforced polymer articles which are subjected to constant deformation in operation such as vehicle tires, transmission belts or conveyor belts, a type of wear of the metal cord called "fretting" occurs between the retaining helix and the surface layer due to friction. This wear occurs locally at the points of contact between retaining helix and surface layer and is all the stronger the more the angle between the extension of the retaining helix and the respective wire of the surface layer approaches 90°. By the same token, it increases with rising surface pressure in this zone and is naturally locally strongest when there are few points of friction.

If the stranding of the metal cord is effected in several operations, involving layers of different sense of twist, such as in an SSZS arrangement (layer-stranded or layered cable), the enveloping curve of the cable cross section approaches more or less that of a full circle; there are many points of contact for the retaining helix so that there is a less intense, uniform wear.

In the production of compact cord, the individual cord layers are cabled in a single operation with the same twisting sense. This permits the densest packing of the individual strands, i.e. the strands lay closely side by side over the entire length of the cable. As a result, the enveloping curve of the cable cross section forms a polygon with rounded-off corners which twists in cabling direction over the layer of the cord.

This causes heavy fretting in the zone of the rounded-off corners.

The problem was to provide a construction, in particular of a compact cord, in which the disadvantages of fretting (frictional wear) between retaining helix and outer layer of the metal cord are reduced.

To solve this problem, the metal cord according to the invention is characterized in that it is provided with a core strand of shorter twisting pitch than the twisting pitch of the strands of the outer layer.

The metal cord according to the invention can be produced in one single cabling operation; the stronger twisting pitch of the core strand causes the core strand to behave like a cylindrical body in relation to the outer strands, so that the outer cross section of the metal cord according to the invention approaches that of a circle. This creates many points of contact with the retaining helix at which the surface pressure is comparatively low. As a result, a reasonably slight, uniform frictional wear occurs between retaining helix and outer layer of the metal cord.

Advantageously, the twist of the core strand is twice as long as the twist of the outer layers; this corresponds to a twisting pitch ratio of core strand to outer layer of 1:2.

A further object of the invention is the complete elimination of the action of the retaining helix on the metal cord in the finished product. This object is achieved in a metal cord according to the invention by making the retaining helix of a material whose softening temperature is at least partially lower than or within the cross-linking (vulcanizing) temperature range of the elastomer to be reinforced.

The material of the retaining helix softens during the cross-linking of the elastomer (such as during vulcanization of the vehicle tire) and the retaining helix at least partially loses its body form. For this purpose, the softening portion of the material of the retaining helix can be so selected that it is compatible with the elastomer to be reinforced. It can also react with the elastomer at its cross-linking.

In order to reduce the surface pressure between retaining helix and outer layer of the metal cord, a further feature of the invention provides that the contacting surfaces between retaining helix and outer layer of the metal cord are increased by using a retaining helix whose cross section is not circular, but instead in particular approximately rectangular. The retaining helix is then wound with a flattened side onto the outer layer of the metal cord.

A retaining helix profile flattened in this way is provided, above all, for retaining helixes made of plastics material or rubber.

The softening portion of the material of the retaining helix can consist of rubber or a corresponding thermoplastic material, the retaining helix can consist wholly or partially of these materials.

A flattening in the superposing zone at simultaneous reduction of the tensile stress in the retaining helix and thus of its surface pressure in the finished product can also be achieved by forming the retaining helix as a rubber/metal or plastics/metal composite or compound body, in particular as a metal wire enclosed by a sprayed-on layer of rubber or plastics material.

In this, the original cross section of the retaining helix can be circular. During the cross-linking of the elastomeric body to be reinforced, the rubber or plastics material softens and the retaining helix flattens out and rubber or plastics material entrapped between the metal core of the helix and the surface layer of the metal cord escapes outward due to the original surface pressure.

Figure 1:
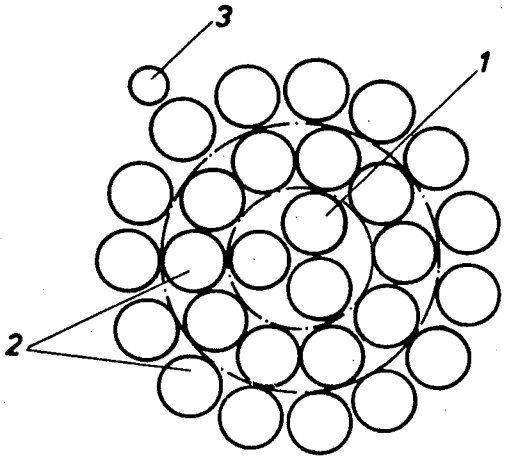

The invention is explained in detail in the following by means of an example under reference to the drawing in which FIG. 1 shows a metal cord according to the invention in cross section and FIG. 2 shows an enlarged cross-sectional side view.

The drawing shows a core strand 1 consisting of three individual wires, two other strands 2 consisting of nine and fifteen individual wires each and a retaining helix in the form of an individual wire of smaller diameter. Cabling is done in the right-hand sense (SSSZ) in one operation. The retaining helix 3 could of course be of the same twisting sense as the outer strands 2. Further, the core strand 1 can be of the same twisting sense as the outer strands 2. The core strand 1 can further be of the opposite twisting sense in relation to the outer strands 2. It is possible to provide a plurality of outer strands.

It is evident from the side view of the retaining cord that the strong twisting of the core strand 1, i.e. its shorter twisting pitch as compared to the twisting pitch of the outer strands 2, makes it possible that the enveloping surface of the core strand 1 largely approaches a cylinder surface even at only three individual wires, which all the more applies to the enveloping surface of the outer layer 2.

I claim:

1. A metal cord for reinforcing elastomeric bodies and having a plurality of strands of identical twisting sense, comprising a core and at least one adjacent outer layer, the strands of the core having a shorter twisting pitch than the twisting pitch of the adjacent outer layer, and having at least one retaining helix on the outside of said cord, said helix being made of a material whose softening temperature is in a range which at least partially overlaps the cross-linking temperature range of the elastomer to be reinforced.

2. A metal cord according to claim 1, wherein the twisting pitch ratio of the core strand to the adjacent outer layer is 1:2 or less.

3. A metal cord according to claim 1 or 2, wherein the helix material is adapted to react with the elastomer at cross-linking.

4. A metal cord according to claim 1, 2 or 3, wherein the cross-section of the helix is flattened and non-circular where it contacts the outside of the cord.

5. A metal cord according to claim 1, 2, or 4, wherein the helix further comprises a metal core within the helix material.

* * * * *